US005873482A

United States Patent [19]

Conti

[11] Patent Number: 5,873,482

[45] Date of Patent: Feb. 23, 1999

[54] TAMPER-EVIDENT CONTAINER CLOSURE

[75] Inventor: Rino Conti, Stoughton, Mass.

[73] Assignee: Plastican, Inc., Leominster, Mass.

[21] Appl. No.: 994,536

[22] Filed: Dec. 19, 1997

[51] Int. Cl.[6] ..... B65D 17/32

[52] U.S. Cl. ..... 220/266; 220/268

[58] Field of Search ..... 220/266, 268, 220/277, 351, 784

[56] References Cited

U.S. PATENT DOCUMENTS

| | | | |
|---|---|---|---|
| 4,111,329 | 9/1978 | Lampman | 220/266 |
| 4,555,042 | 11/1985 | Rathbun | 220/277 |
| 4,655,363 | 4/1987 | Neat | 220/268 |
| 4,966,302 | 10/1990 | Hjordie | 220/268 |
| 4,998,622 | 3/1991 | Drack | 220/266 X |
| 5,170,905 | 12/1992 | Luch | 220/784 X |
| 5,303,839 | 4/1994 | Blumenschein | 220/266 X |
| 5,307,948 | 5/1994 | Blackburn et al. | 220/268 X |
| 5,437,386 | 8/1995 | Van Holdt | 220/268 X |

*Primary Examiner*—Steven M. Pollard

*Attorney, Agent, or Firm*—Pandiscio & Pandiscio

[57] ABSTRACT

A tamper-evident closure for a container is provided. The container is formed with means at its open upper end for making a snap fit locking connection with a cover. The container has a peripheral flange with a skirt section that surrounds and is spaced radially from the container's side wall, and the cover has a depending skirt that extends down around the upper end of the container and has a free bottom edge that lies immediately adjacent to the flange. The flange has an outer surface that is flush with the adjacent portion of the outer surface of the skirt, so that essentially the flange appear to be a continuation of the skirt. As a consequence the closure formed by the cover (lid) and the container is resistant to opening by a small child. Additionally the skirt section of the flange has a tab portion that is breakable under pressure so that, once broken, it can be depressed inwardly toward the container side wall far enough to permit a person to engage the bottom edge of the skirt on the cover and thereby force the cover off of the container. The tab portion functions as a tamper evident feature, since the fact that it has been broken can be easily discerned from inspection and since the torn tab cannot be restored to its original condition.

16 Claims, 5 Drawing Sheets

TAMPER-EVIDENT CONTAINER CLOSURE

FIELD OF THE INVENTION

The present invention pertains to provision of a container with a tamper evident closure that also is resistant to opening by a small child.

PRIOR ART

Heretofore efforts have been made to provide containers with child resistant closures, i.e., closures that are difficult for children to open. this in the case where the closure involves a removable lid or cover, the combination of container and lid or cover is designed so a small child cannot effect removal of the lid or cover from the container.

Also known are efforts to make containers with tamper-evident closures, i.e., closures that are designed to indicate that they have been tampered with. Child resistant and tamper evident lids are especially important in the case of containers for over the counter and prescription drugs. A variety of different closures designs have been patented and used, some specifically for relatively small containers and others for containers of moderate or large size. Each known closure design has its own advantages and limitations. Examples of child resistant and tamper-evident closures are provided by U.S. Pat. Nos. 5,411,160, issued 2 May, 1995 to Goulet et al for Child Resistant Closure, and 5,224,617, issued 6 Jul., 1993 to M. Gaudrealt for Tamper Evident Container, and the prior art patent documents cited therein.

OBJECT AND SUMMARY OF THE INVENTION

A primary object of the present invention is to provide a novel tamper-evident closure for plastic containers.

Another primary object of this invention is to provide a novel child-resistant closure for plastic containers.

A further object is to provide plastic containers having a novel closure design that is both child resistant and tamper evident.

The foregoing objects, and other objects stated in or rendered obvious by the following specification are achieved by providing (1) a container having a peripheral flange and (2) a cover or lid that fits over and makes a snap-fit connection with the open top end of the container, the cover or lid having a depending skirt that abuts the peripheral flange and has an outer surface that is flush with the adjacent portion of the outer surface of the flange, so that essentially the flange appear to be a continuation of the skirt. As a consequence the closure formed by the cover (lid) and the container is resistant to opening by a small child. Additionally the flange has a tab portion that is breakable under pressure so that, once broken, it can be depressed inwardly toward the container side wall far enough to permit a person to engage the bottom edge of the skirt and thereby force the cover off of the container. The tab portion functions as a tamper evident feature, since the fact that it has been broken can be easily discerned from inspection and since the torn tab cannot be restored to its original condition. Other features and advantages of the invention are obvious from the following detailed description of a preferred embodiment of the invention which is to be considered together with the accompanying drawings.

THE DRAWINGS

In the several figures, like numerals designate like components.

DESCRIPTION OF PREFERRED EMBODIMENT

Figure 1:
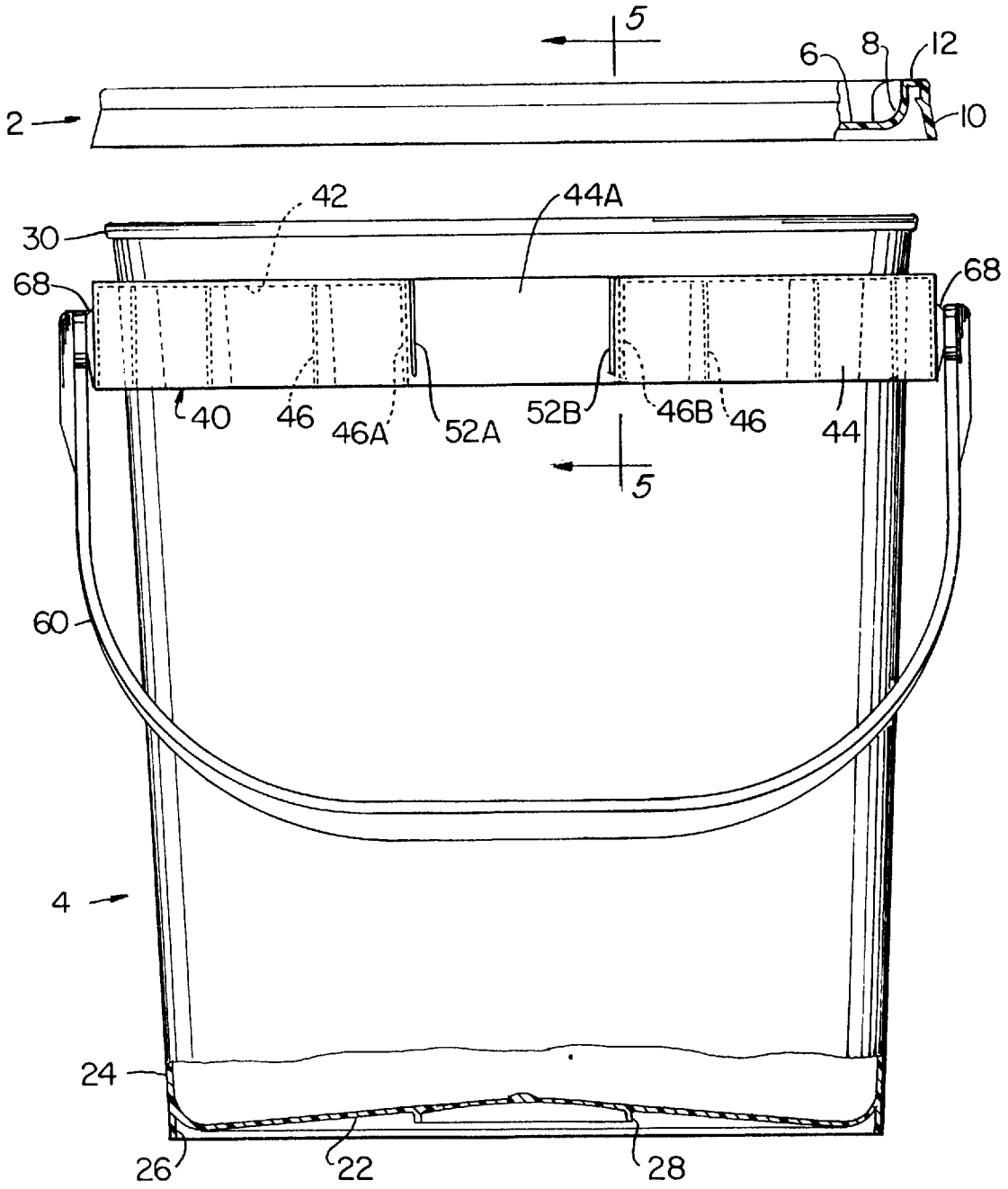
FIG. 1 is an exploded side view showing a container and lid embodying the present invention, with portions show in cross-section.
Figure 2:
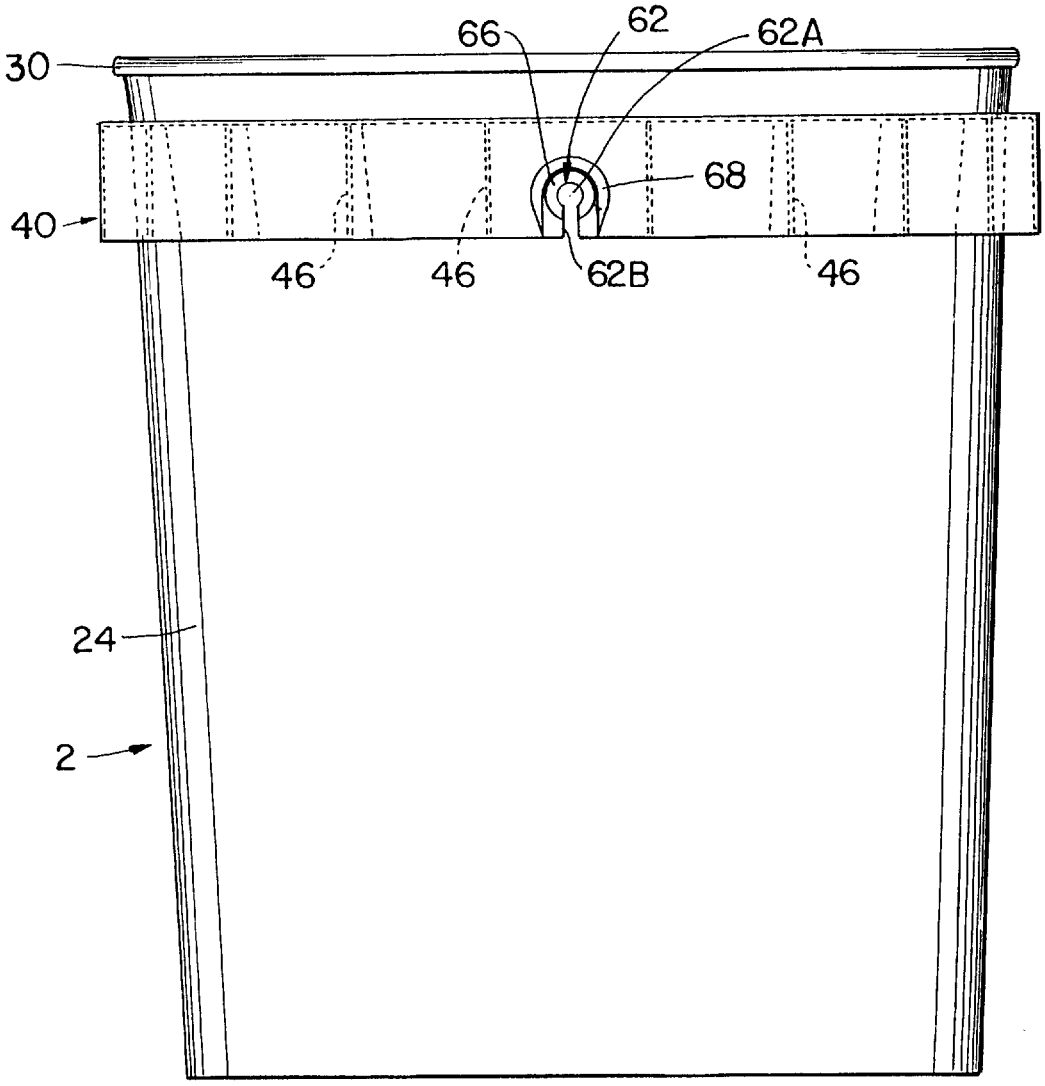
FIG. 2 is a side elevation of the same container rotated 90° from the view of FIG. 1.

Referring first to FIGS. 1 and 2, the illustrated embodiment comprises a lid or cover 2 and a container 4, both preferably molded of a resilient plastic such as polyethylene. However they may be made of some other plastic material so long as the lid has adequate flexibility and resiliency to permit it to be applied to the container by a snap fit connection. By way of example but not limitation, they may be made of polypropylene, polyvinylchloride ("PVC") or a natural or synthetic elastomer. As used herein, the terms "lid" and cover are intended to be synonymous with one another.

Figure 5:
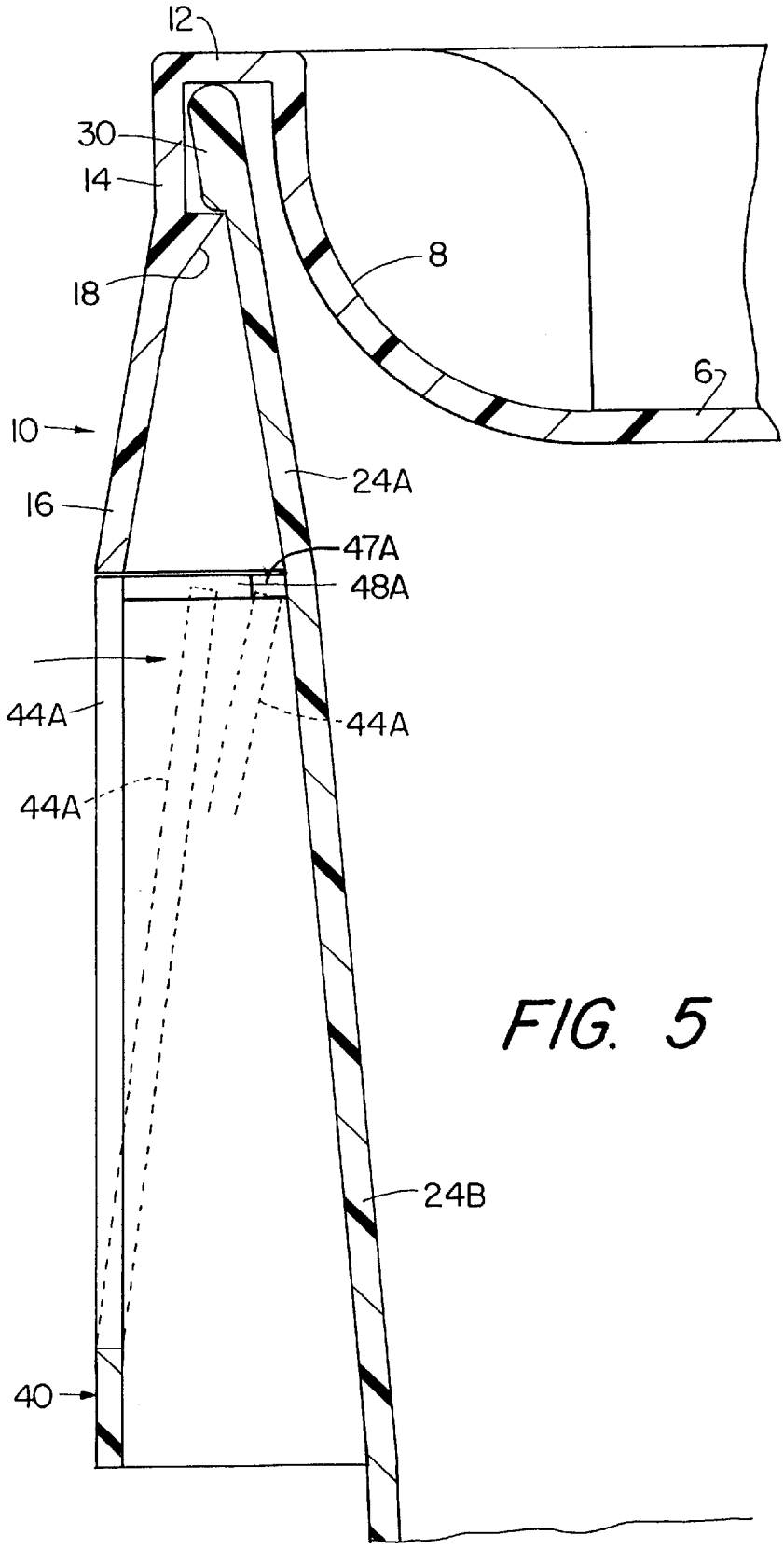
FIG. 5 is a sectional view in elevation illustrating how the tab portion can be ruptured and pushed inwardly to facilitate removal of the lid.

Referring to FIGS. 1 and 5, lid 2 is circular and has a circular body section 6 surrounded by and integral with a circular rim section that comprises an upwardly curved inner wall 8, a depending skirt 10 and a top annular wall 12 connecting wall 8 and skirt 10. Preferably as shown the upper portion 14 of skirt 10 has a generally cylindrical shape, while the remainder 16 of the skirt tapers outwardly so as to have a generally frusto-conical shape. The inner surface of skirt 10 is formed with a circumferentially extending rib 18. Although rib 18 is shown as having a saw-tooth shaped cross-section, it may be formed with some other cross-sectional shape so long as it can function as a lid locking member as described below. The annular gap between curved inner wall 8 and skirt 10 serves as a channel for receiving the circular upper end of container 4, as shown in FIG. 5 and as further described below. The minimum width of the channel is between the innermost edge of rib 18 and wall 8.

Container 4 comprises a bottom wall 22 and a side wall 24. The latter is circular in cross-section but is tapered, having its smallest outside diameter at its juncture with bottom wall 22. The tapered side wall allows a number of the containers to be stacked one inside of the other. The taper may be uniform from top to bottom or, as shown in FIG. 5, the taper at the upper end portion 24A of side wall 24 may be different than the taper for the remaining lower portion 24B of that wall. Preferably, but not necessarily, the bottom end of the container has a circular flange 26 that projects beyond bottom wall 22 and serves as a position stabilizing ring for the container when it is seated on a supporting surface such as a table or floor. Also preferably but not necessarily, the bottom wall is curved inwardly (FIG. 1) and is provided with a centrally located circular reinforcing ring 28 on its under side.

The upper end of side wall 24 is formed with a peripheral locking bead or ridge 30 (FIG. 5). Preferably the underside of bead 30 is made substantially flat and extends at a right angle to the plane of side wall 24, so as to permit it to better make a locking connection with rib 18 of the lid. The combined thickness of side wall 24 and bead 30 may be the same as or slightly larger than the minimum width (radial dimension) of the channel between rib 18 and curved lid wall 8; alternatively as shown in FIG. 5 the combined thickness of side wall 24 and bead 30 may be slightly less than the minimum width of the channel. However, bead 30 projects outwardly of side wall 24 far enough for its minimum outer diameter to exceed the minimum inner diameter of rib 18, so that in order to apply the lid to the container the skirt 10 needs to be deformed outwardly to allow bead 30 to intrude into the channel far enough to pass rib 18, whereupon the skirt will spring back to its original shape so as to cause rib 18 to make a snap lock connection with bead 30 in the manner shown in FIG. 5.

Figure 3:
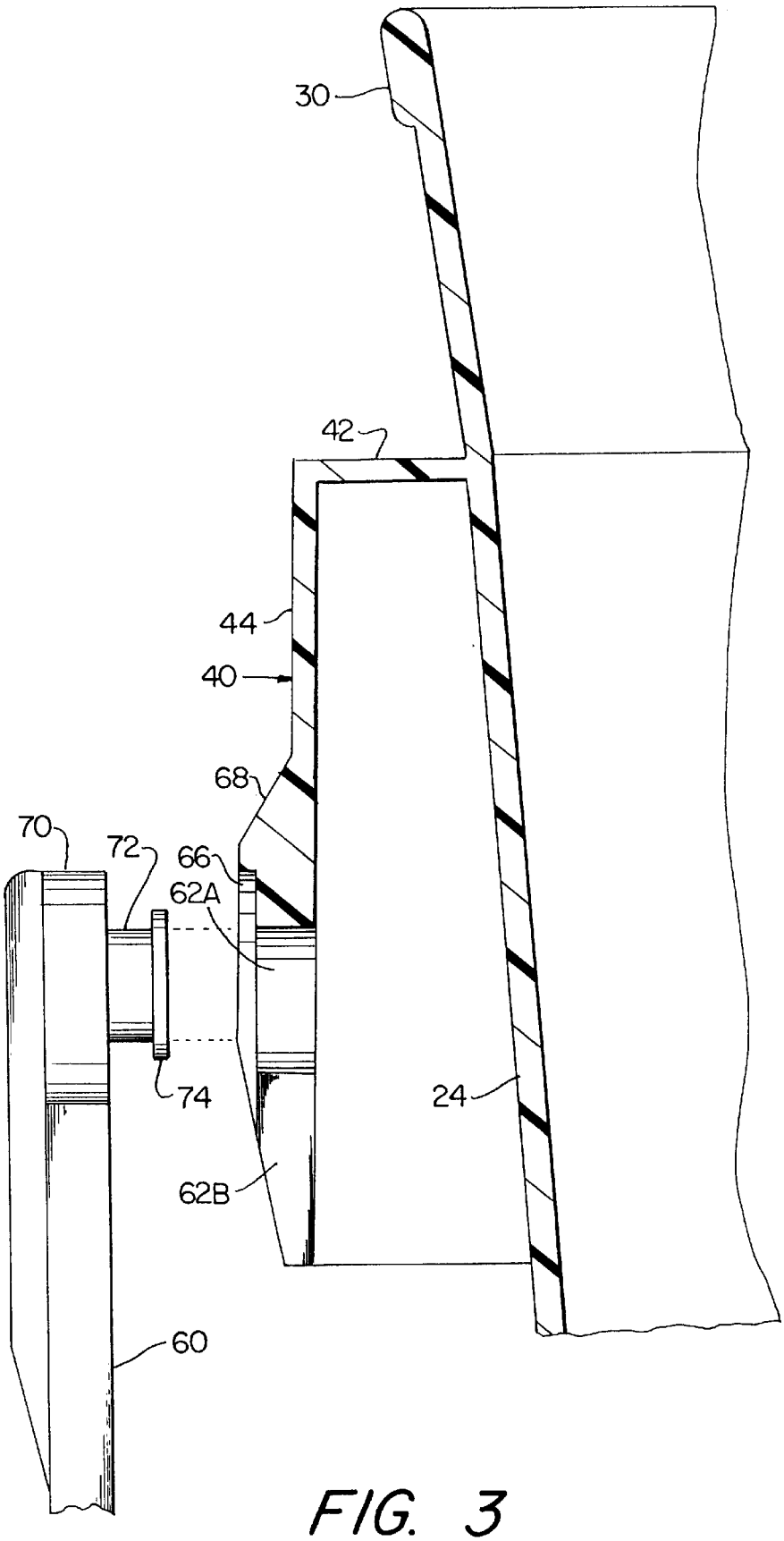
FIG. 3 is a fragmentary cross sectional and exploded view illustrating details of the of the container and the handle that permit the handle to make a removable pivotal connection to the container.
Figure 4:
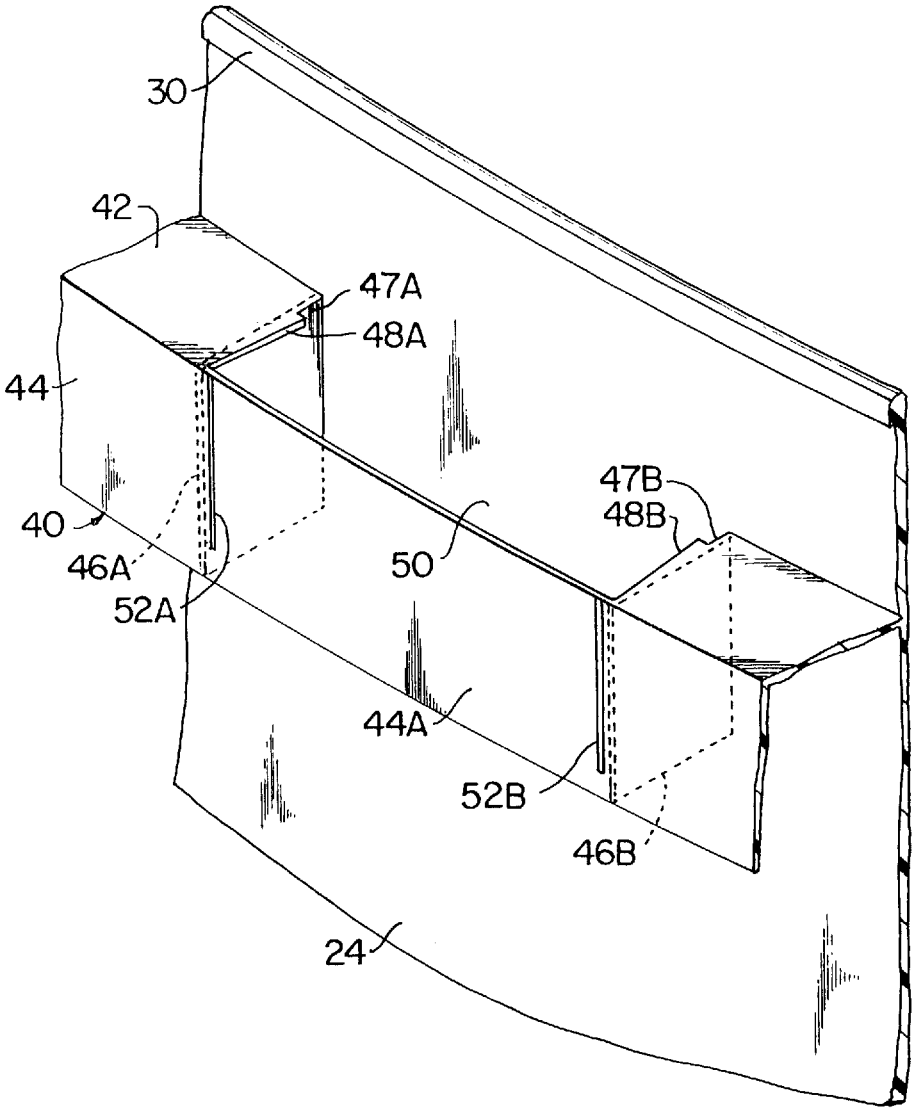
FIG. 4 is a fragmentary-perspective view showing details of the tab portion of the flange on the container.

The side wall of the container is formed with an external flange 40 adjacent to but short of its top end. Flange 40 comprises a ring section 42 (FIGS. 3 and 4) that is formed integral with the outer surface of side wall 24 and a tubular (preferably cylindrical) skirt section 44 that is formed integral with and depends from the outer edge of ring section 42. Skirt section 44 extends around and in spaced relation with side wall 24 and is supported by a plurality of circumferentially spaced webs 46 that are connected to and extend radially between it and wall 24. Webs 46 are molded integral with flange sections 42 and 44 and also with wall 24. Ring section 42 extends around side wall 24 for a distance less than 360°, having spaced end edges 47A and 47B (FIG. 4) that define the opposite ends of a gap 50 and are characterized by sawtooth (triangular) shaped projections 48A and 48B. Gap 50 is also defined by portions of side wall 24 and flange skirt section 44. The latter section is formed with two score lines 52A and 52B in its outer surface 54 in the region between the opposite end edges 47A, 47B of ring section 42, more specifically betwen the outer ends of projections 47A, 47*b*, as shown in FIG. 5. The two score lines demarcate a breakable tab portion 44A of flange section 44. Score lines 52A, 52B preferably are in the form of grooves having a V-shaped cross-sectional configuration. The score lines are made deep enough to permit flange section 44 to be ruptured by a manually applied force in the region of gap 50. By way of example, if the container is made of polyethylene and flange skirt section 44 has a thickness of about 0.045", the score lines preferably have a depth of in the range of 0.035–0.040".

To facilitate rupturing, two webs 46A and 46B are formed immediately adjacent to the opposite end edges of gap 50. The two score lines are closer to one another than are webs 46A and 46B, so that the latter buttress flange section 44 on either side of the score lines. As a consequence if tab portion 44A is pressed inwardly toward side wall 24, the adjacent portions of flange section 44 at webs 46A, 46B will resist being deflected inwardly toward side wall 24 and the tab section will readily shear along score lines 52A, 52B. Score lines or grooves 52A, 52B are formed so that they extend straight down from the upper edge of flange section 44 to a point short of its free bottom edge. Accordingly when tab portion 44A is pressed inwardly toward side wall 24, it will rupture along the two score lines, but it will not tear completely free of flange section 44. Instead it will be deflected inwardly, as shown in FIG. 5, far enough to permit the user to grasp the lower edge of skirt 10 of cover 2, whereby the user can then force the lid off of the container.

The sawtooth shaped projections 48A, 48*b* serve as detents. When tab portion 44A is pressed inwardly as shown in FIG. 5, its side edges will engage the adjacent edge of projections 48A, 48B, causing the flexible tab portion to bend enough to allow its side edges to move past the inner ends of along the projections 48A, 48B, whereupon the side edges of the tab portion will snap into place behind the projections 48A, 48B. When this occurs, projections 48A, 48B will act to as detents to hold the tab portion in its inner deflected position (see fragmentary dotted line position of tab portion 44A as shown in FIG. 5). Of course, since the tab portion 44A is flexible, the user can release it from projections 48A, 48*b* by manually forcing it past those projections back to its original position.

Flange 40 also serves as a mount for a bail or handle 60. For this purpose, flange section 44 has two identical keyhole shaped slots 62 at two diametrically opposed locations. Each keyhole slot comprises a circular end section 62A and a tapered channel section 62B. In the illustrated embodiment, keyhole slots 62 are 90 degrees removed from tab section 44A. Adjacent each keyhole slot the outer surface of flange section 44 is formed with a flat arcuate surface area 66 that surrounds keyhole circular end section 62A and a portion of each keyhole channel section 62B. Each flat arcuate surface area 66 is surrounded by a circularly curved ridge 68 that serves as a pivot guide for the attached end of handle 60. The latter is also molded of a flexible plastic material and each of its two ends has a round shoulder 70, as well as a pivot shaft 72 that projects at a right angle from shoulder 70 and is terminated by a circular end flange 74. Keyhole slots 62 are widest where their channel sections intersect the bottom edge of flange section 44 and narrowest where their channel sections 62B join circular end sections 62A. Each pivot shaft 70 has a diameter that is smaller than the widest part of channel section 62B and also smaller than the diameter of circular end section 62A, but slightly larger than the narrowest part of channel section 62B. The ends of handle 60 are attached to flange section 44A by inserting pivot shafts 72 into keyhole channel sections 62B and then forcing those shafts into keyhole circular end sections 62A, so as to make a snap-type and rotatable connection to the container. When so positioned, the ends of the handle cannot slip out of the keyhole slots but can shafts 72 can pivot in the circular end sections 62A, allowing the handle to be moved between a raised container-carrying position and a lowered handle-storing position. The end flanges on shafts 72 prevent the shaft from being pulled axially out of the keyhole slots, while ridges 68 coact with round shoulders 70 to limit lateral motion of the pivot shafts and also provide protection for shoulders 70.

The height of skirt 10 of the lid and the location of flange 40 on the side wall of the container are selected so that when the lid is attached, the bottom edge of the skirt abuts or nearly abuts flange ring section 42. Additionally, the outer diameter of skirt 10 at its bottom edge is made the same as the outer diameter of flange skirt section 44 at its junction with ring section 42. Consequently when the lid is secured in place on the container, the bottom end of the outer surface of skirt 10 appears to be a continuation of the upper end of the outer surface of flange section 44. The result is a child resistant closure. by way of explanation, removal of the lid by hand is difficult since there is no room to insert a finger under the skirt on the lid for the purpose of forcing it off of the container.

Of course, the lid could be removed from the container by inserting a wedging tool such as a chisel or screwdriver between flange section 42 and the bottom edge of skirt 10, and then manipulating the tool so as to pry the lid off of the container, but that method of opening the container is still difficult for a small child. Moreover, using a tool to pry open the container might mark up the plastic lid and/or the container, and such marks would tend to be quite visible.

The easiest way for a person to open the closure is to depress tab portion 44A of flange section 44 far enough to permit positioning a finger under the bottom edge of that flange section, whereupon person has enough purchase to force the lid off of the container. However, the score lines are sufficiently deep as to readily rupture when the tab portion is pushed in under ring section 42. Hence if a container has been opened by depressing tab portion 44A far enough to place a finger under skirt 10, the fact that it has been opened will be evident by the further fact that the integrity of flange section 44 has been violated by rupturing of tab portion 44A.

Obviously the container and lid shown in the drawings may be modified in various ways without departing from the principles of the invention. For example, the depth, width and length of the score lines may be varied, and the V-groove type score lines may be replaced with a serrated type score line or each score line may take the form of a series of closely spaced small depressions or perforations. Also score lines for two tabs 44A could be provided, with the two tabs being angularly displaced from one another around the container side wall. If desired, the sawtooth projections 48A, 48*b* that function as detents also may be omitted. The distance of flange 40 from the top end of the container also may be varied, in which case the height of skirt 10 will be changed so assure that there is little or no gap between the bottom edge of the skirt and the upper end of the flange. Although the ring section 42 of flange 40 is shown as extending at a right angle to the side wall of the container, it is appreciated that ring section 42 could be canted, e.g., it could slope down and away from its line of attachment with side wall 24. Details of the snap-type connection provided by the lid and container also may be varied. For example, depending on the degree of sealing required between lid and container, rib 18 be replaced by a series of short circumferentially spaced ribs, and the same may be done with respect to bead 30. However, in the case where the contents of the container is a liquid and it is desired to assure that no leakage can occur, the upper end of the channel formed between inner lid wall 8 and skirt 10 may be fitted with a gasket for engagement by the top edge of the container, thereby providing an hermetic seal. It also is contemplated that the container need not be circular in cross-section. Instead, for example, the container may be made with a rectangular cross-sectional configuration, in which case its side wall would comprise 4 side wall panels and the flange 40 would extend laterally across each side wall panel, and the tab portion may be located at any side panel or even at more than one side panel. Likewise, the cover would be rectangular rather than circular.

As noted above, with the foregoing construction, it is difficult to remove the lid from the container except by use of a prying device or except by first rupturing the tab portion 44A. In both cases violating the integrity of the original closure tends to be evident; if the closure is opened by using a prying tool such as a chisel or screwdriver, that fact would be evidence by physical marring of the lid or container by the prying tool; if the closure is opened by depressing tab portion 44A (the intended procedure, access to the container is made evident by the fact that the tab has been ruptured.

Other modifications and advantages of the invention will be obvious to persons skilled in the art.

What is claimed is:

1. A covered container with a tamper evident closure, said covered container comprising, in combination:

a cover member including a main cover portion and a peripheral rim portion, said rim portion including cover securement means and a peripheral skirt that has inner and outer surfaces and terminates in a free edge;

an open top container member comprising a bottom wall and a side wall together defining a predetermined volume, said side wall having a bottom end formed integral with said bottom wall and a top end that is releasably and lockingly engaged with said cover securement means, said side wall also having an integral outwardly extending peripheral flange that is spaced from said container member top end;

said flange including (a) a ring section that is formed integral with and projects radially from said side wall and (b) an skirt section that is formed integral with said ring section and extends away from said ring section and said top end of said container in surrounding spaced relation with said side wall;

said peripheral skirt of said cover member having outer and inner surfaces and extending away from said main cover portion a distance such that its free edge terminates in contacting or near contacting relation with said ring section of said flange;

said ring section surrounding said side wall and having top and bottom surfaces and first and second ends that are mutually spaced from one another so as to define a circumferentially extending gap between said first and second ends;

said flange skirt section having an outer surface that is substantially flush with said outer surface of said peripheral skirt of said cover member, said skirt section also having a top end and a bottom end, with said top end joined to said ring portion, and first and second frangible score lines formed in said skirt section, said first and second score lines intersecting the plane of said top surface of said ring section at or between said first and second ends of said gap, said score lines each extending from said top end of said skirt section toward said bottom end of said skirt section and terminating short of said bottom end so as to define a tab portion of said skirt section, said skirt section being breakable along said score lines when pressure is applied to said tab portion in the direction of said side wall, thus providing a visual indication of tampering, whether authorized or unauthorized, and allowing a person to engage the bottom edge of said peripheral skirt between said first and second ends of said ring section so as to facilitate removal of the cover member from the container member.

2. A covered container according to claim 1 wherein said score lines are formed in the outer surface of said flange skirt section.

3. A covered container with a tamper evident closure, said covered container comprising, in combination a container member and a cover member;

said cover member including a main cover portion and a peripheral rim, said rim including securement means for releasably locking said cover member to said container so as to form a closure, and a peripheral skirt extending downwardly away from said securement means and terminating in a free edge;

said container member having a open top and comprising a bottom wall and a side wall together defining a predetermined volume, said side wall having a bottom end formed integral with said bottom wall and a top end that is adapted to make a locking engagement with said cover member securement means, whereby said cover provides a closure for said container; said side wall also having an integral outwardly extending peripheral flange spaced from said container member top end;

said flange including (a) a radially projecting ring section that is formed integral with and extends around said side wall, and (b) a skirt section that is formed integral with said ring section and extends around and is spaced from said side wall, said skirt section also extending away from said ring section and said top end of said container member, and said skirt section having an outer diameter adjacent said ring section that is substantially the same as the outer diameter of said skirt at said free edge;

said peripheral skirt extending away from said main cover portion so that its free edge terminates in contacting or near contacting relation with said ring section of said flange, whereby said outer surface of said peripheral skirt and the outer surface of said skirt section are substantially flush with one another at the junction of said free edge and said ring section of said flange;

said ring section having top and bottom surfaces and at least one hole that extends through said top and bottom surfaces, said at least one hole having first and second circumferentially spaced ends;

said skirt section having a top end and a bottom end, with said top end joined to said ring section, and first and second frangible score lines formed in said skirt section, said first and second score lines intersecting the plane of said top surface of said ring section substantially in line with said first and second circumferentially spaced ends of said hole, said score lines each extending from said top end toward said bottom end of said skirt section and terminating short of said bottom end so as to define a tab portion of said skirt section, said skirt section being breakable along said score lines when pressure is applied to said tab portion, thus providing a visual indication of tampering, whether authorized or unauthorized, and allowing a person to engage the free edge of said peripheral skirt between said first and second ends of said hole so as to facilitate removal of the cover member from the container member.

4. A covered container according to claim 3 wherein said score lines are spaced from one another a distance equal to or greater than the distance between said first and second ends of said hole.

5. A covered container according to claim 3 wherein said score lines are formed in the outer surface of said skirt section of said flange.

6. A covered container according to claim 3 further including a plurality of mutually spaced radially extending support webs formed integral with and extending between said inner surface of said skirt section and said outer surface of said container side wall.

7. A covered container according to claim 6 having one of said support webs located close to each end of said tab section.

8. A covered container according to claim 3 wherein said upper surface of said ring is flat.

9. A covered container according to claim 3 wherein said container side wall is tapered, having a larger outer diameter at said top end than adjacent said bottom wall.

10. A covered container according to claim 3 wherein said skirt is spaced radially from said main cover portion of said cover member so as to form a channel therebetween, said cover securement means is formed in said channel, and said top end of said container extends into said channel for engagement with said securement means.

11. A covered container according to claim 10 wherein said securement means comprises at least one locking rib on the inner surface of said skirt that reduces the width of said channel adjacent the junction of said rim and said main cover portion, said top end of said container member has at least one mating bead formed integral with and extending circumferentially along its said top end, the thickness of the top end of said side wall at the location of said at least one mating bead being greater than the width of said channel at the location of said at least one locking rib, and said cover member being made of a flexible resilient plastic material so that said cover member can be attached to said container member by a snap-type locking action characterized by flexing of said cover so that said channel (a) first expands in width to permit said at least one locking rib to pass over and by said at least one mating bead and (b) then contracts in width so as to cause said at least one locking rib to grip said at least one mating bead, thereby releasably locking said cover member to said container member.

12. A covered container according to claim 3 further including a handle pivotally secured to said skirt section of said flange at two diametrically opposed locations.

13. A covered container according to claim 12 wherein said skirt section has two diametrically opposed keyhole slots, the opposite ends of said handle carry pivot shafts that are rotatably mounted in said keyhole slots, and further including means attached to said pivot shafts for preventing said pivot shafts from being pulled axially out of said keyhole slots.

14. A covered container according to claim 3 wherein said tab portion is bendable inwardly toward said side wall to a selected position when said skirt is broken along said score lines, and further including detent means engageable by said tab portion for holding said tab portion in said selected position.

15. A container with a tamper evident closure, said container comprising, in combination:

a cover member molded of plastic and including a cover portion and a peripheral rim portion, said rim portion including cover securement means and a skirt extending away from said cover portion and terminating in a free edge; and a container member molded of plastic and comprising a bottom wall and a side wall together defining a predetermined volume, said container member having an open end opposite to said bottom wall, said side wall having means at said open end for engaging said cover securement means so as to releasably lock said cover member to said container member and thereby close off said open end of said container;

said container member also having a peripheral flange formed integral with and surrounding said side wall adjacent said open end thereof, said flange comprising a ring section that extends outwardly from said side wall and a skirt section that is spaced from said side wall and extends from said ring section in a direction generally lengthwise of said container member away from said open end of said container, said skirt section having a first end at its junction with said ring section and a second end remote from said ring section, said skirt portion also having a partially rupturable tab portion defined by and extending between two mutually spaced frangible narrow areas each extending from said first end toward but terminating short of said second end of said skirt section, and said ring section being interrupted in the region corresponding in position to said rupturable portion of said skirt section so that said rupturable portion is unsupported by said ring section;

said ring section having a dimension measured radially from said side wall that is substantially the same as the outer diameter of said skirt at said free edge and being disposed such that said free edge of said cover member skirt lies in near contact with said ring section of said flange when said cover member is secured to said container member by said cover securement means, whereby removal of said cover member may be effected without the use of a tool by rupturing said skirt portion along said two frangible areas so that said rupturable portion can be depressed inwardly toward said side wall far enough to permit said free edge of said cover member to be manually grasped for pulling the cover member away from said container member, the rupturing of said skirt section being readily apparent by visual inspection.

16. A container with a tamper-evident closure according to claim 15 wherein said tab portion is bendable inwardly toward said side wall to a selected position when said skirt is ruptured along said two frangible areas, and further including detent means on said ring section engageable by said tab portion for holding said tab portion in said selected position.

* * * * *